US007023396B2

(12) United States Patent
Thudor et al.

(10) Patent No.: US 7,023,396 B2
(45) Date of Patent: Apr. 4, 2006

(54) BROADBAND ANTENNA WITH OMNIDIRECTIONAL RADIATION

(75) Inventors: Franck Thudor, Rennes (FR); Jean-François Pintos, Bourgbarre (FR)

(73) Assignee: Thomson Licensing, Boulogne-Billancourt (FR)

( * ) Notice: Subject to any disclaimer, the term of this patent is extended or adjusted under 35 U.S.C. 154(b) by 0 days.

(21) Appl. No.: 10/767,759

(22) Filed: Jan. 29, 2004

(65) Prior Publication Data

US 2004/0183740 A1 Sep. 23, 2004

(30) Foreign Application Priority Data

Jan. 30, 2003 (FR) ..... 03 01032

(51) Int. Cl.
*H01Q 9/38* (2006.01)

(52) U.S. Cl. ..... 343/829; 343/797; 343/799

(58) Field of Classification Search ..... 343/799, 343/797, 795, 846, 848, 829, 830, 893, 912
See application file for complete search history.

(56) References Cited

U.S. PATENT DOCUMENTS 3,987,458 A * 10/1976 Reggia et al. ..... 343/846
4,814,777 A * 3/1989 Monser ..... 343/727
5,872,546 A * 2/1999 Ihara et al. ..... 343/795

FOREIGN PATENT DOCUMENTS

EP 0802579 10/1997

OTHER PUBLICATIONS

Patent Abstracts of Japan, vol. 2002, No. 10—JP 2002 164731.
Desclos et al.: "1.6-6 GHz optimized antennas for indoor wireless LAN applications", Wireless Applications Digest, 1007; IEEE MTT-S Symposium on Technologies for Vancouver, BC, Canada 13-16 FRB. 1997, NY, USA, IEEE, pp. 39-42.
Agrawall, et al.: "New wideband monopole antennas", Antennas and Propagation Society International Symposium, 1997, IEEE 1997 Digest, Montreal, Que. Canada Jul. 13-18, 1997, NY, USA, IEEE pp. 248-251.
Patent Abstracts of Japan, vol. 1998, No. 11, Sep. 30, 1998,—JP 10 150318 A.

* cited by examiner

*Primary Examiner*—Hoang V. Nguyen
(74) *Attorney, Agent, or Firm*—Joseph S. Tripoli; Robert D. Shedd; Brian J. Cromarty

(57) ABSTRACT

The present invention relates to a broadband antenna with omnidirectional radiation comprising a first circular or semicircular monopole perpendicular to an earth plane, and at least one second circular or semicircular monopole, the monopoles being positioned with respect to one another in such a way as to have a common diameter.

4 Claims, 6 Drawing Sheets

BROADBAND ANTENNA WITH OMNIDIRECTIONAL RADIATION

This application claims the benefit under 35 U.S.C. § 119 (a) of French patent application No. 0301032 filed Jan. 30, 2003.

The present invention relates to a broadband antenna with omnidirectional radiation intended to receive and/or to transmit electromagnetic signals that can be used in the field of wireless communications, more particularly in the case of transmissions for digital terrestrial television.

BACKGROUND OF THE INVENTION

Digital terrestrial television will eventually replace analogue television. Within the context of this progress, it is necessary to be able to offer quality reception, even inside houses or apartments. This obligation of inside reception entails constraints on the size of the receiving antenna which should not be bulky.

At present, the antennas used for receiving analogue television signals consist, in the case of terrestrial reception, of a so-called "rake" antenna or Yagi type antenna which is traditionally placed on the roof of the house. Antennas of this type may reach 1 meter in length. In the case of antennas for inside reception, they are generally composed of two radiating elements, one for VHF and the other for UHF and may be combined with an active amplification part. Moreover, the standard used in the context of digital terrestrial television is the DVBT standard. This standard provides for the use of all the channels in the UHF band, thereby requiring a broadband antenna.

SUMMARY OF THE INVENTION

The present invention proposes a broadband antenna that is able, in particular, to cover the entire UHF band, namely the band lying between 470 MHz and 862 MHz and which possesses a correct matching level over this entire band.

The present invention relates to a broadband antenna with omnidirectional radiation comprising a first circular or semicircular monopole perpendicular to an earth plane, characterized in that it comprises at least one second circular or semicircular monopole, the monopoles being positioned with respect to one another in such a way as to have a common diameter.

Indeed, although circular monopoles or CDMs (standing for Circular Disc Monopole) are known to be elements that radiate over a broad band of frequencies omnidirectionally, these elements do not exhibit satisfactory matching over the entire operating band. Now, it has been realized that the use of two circular or semicircular monopoles, in accordance with the present invention, allowed a sharp improvement in the performance of the antenna in terms of matching, without modifying the performance in terms of radiation.

According to a characteristic of the invention, the antenna comprises N circular monopoles $N \geqq 2$, the N monopoles being positioned with respect to one another in such a way as to exhibit a common diameter.

According to a first embodiment, the antenna comprises two monopoles making an angle of 90° between themselves. More generally, the value of the angle between two half-monopoles is equal to 180°/N where N is the number of monopoles. According to a variant, the two monopoles make non-identical angles between themselves, in particular angles of 45°/135° or of any other set of values whose sum equals 180°. This configuration entails a reduction in the impedance of the whole, thereby also giving less dispersion and a better level of matching over a broad frequency band.

According to another characteristic of the present invention, the monopoles are mounted with a reflector plane.

BRIEF DESCRIPTION OF THE DRAWINGS

Other characteristics and advantages of the present invention will become apparent on reading the description of various embodiments, the description being given with reference to the appended drawings in which.

DESCRIPTION OF PREFERRED EMBODIMENTS

A first embodiment of a broadband antenna with omnidirectional radiation in accordance with the present invention will firstly be described with reference to FIGS. 1 to 3.

Figure 1:
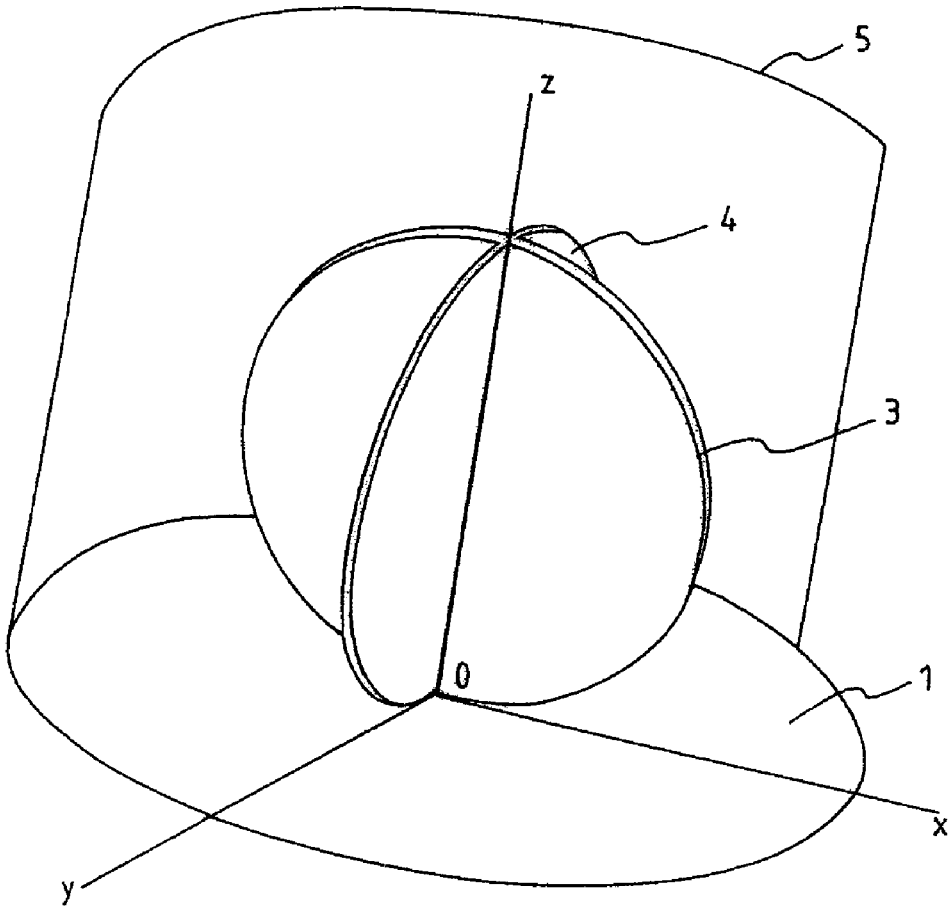
FIG. 1 is a perspective view of a double CDM broadband antenna in accordance with the present invention.

As represented in FIG. 1, two circular discs 3, 4 forming two CDM elements, CDM standing for "Circular Disc Monopole", have been positioned on a metal earth plane 1, perpendicularly to the latter. As represented in FIG. 1, the two circular discs 3, 4 are nested one within the other according to a common diameter z and are perpendicular to the earth plane 1 which lies in the xoy plane. These two discs 3 and 4 are embodied in a known manner by a metal element. In the embodiment of FIG. 1, the two discs 3 and 4 cross one another in such a way as to form a right angle between themselves.

To simulate the results obtained, an antenna as represented in FIG. 1 has been embodied using two identical metal discs each exhibiting a radius a=90 mm and a thickness e=4 mm. These two discs are nested one in the other, as represented in FIG. 1 and they have been mounted on a metal earth plane exhibiting a radius R=150 mm, the two discs lying a distance h=2 mm from the earth plane. The discs and the earth plane are made of metals. They may for example be aluminium. To reduce the weight of the structure, it is possible to use a plastic (such as "dibbon") with a metalization on its faces (with an aluminium foil for example) or else metalized foam.

The structure described above has been simulated using the Ansoft HFSS software and a 35Ω impedance line exhibiting a width of 3.16 mm and a length of 67 mm traced on a Rogers 4003 substrate with relative permitivity $\epsilon r=3.38$ and height 0.81 mm. The 35-ohm impedance line produces a transformer that enables a 50-ohm impedance to be obtained at output on the basis of the impedance of the structure which, in the present case, is 25 ohms, as explained hereinbelow. The results of the simulation are given in FIGS. 2 and 3.

Figure 2:
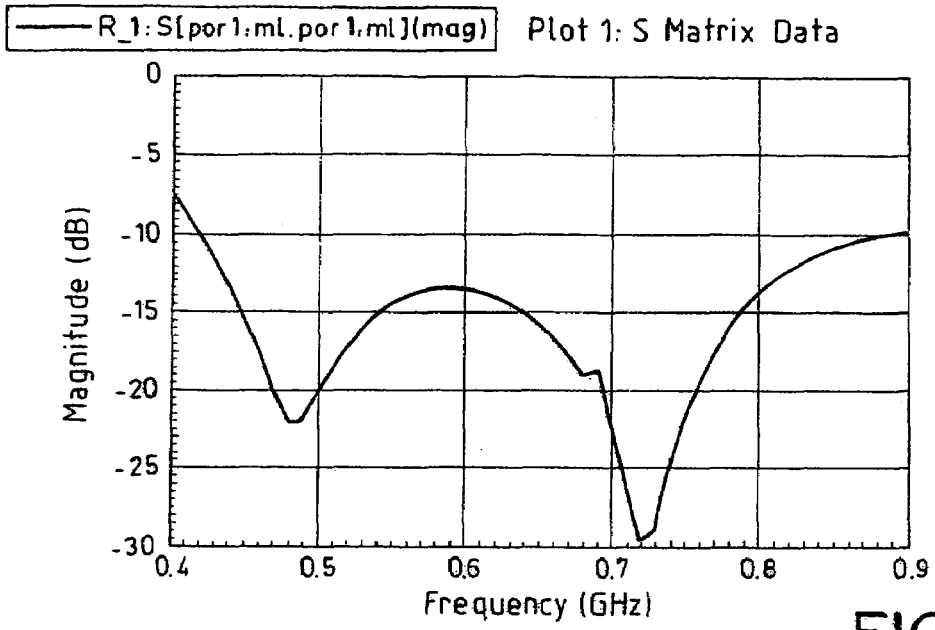
FIG. 2 is a curve giving the matching coefficient as a function of frequency of the antenna represented in FIG. 1.

In this case, the curve of FIG. 2 shows that with the antenna of FIG. 1 a considerable matching level is obtained that may reach up to 30 dB over the entire UHF band, namely the band lying between 470 MHz and 860 MHz. The results obtained may be explained by the fact that the nesting of the two discs, as described hereinabove, amounts from an electrical point of view to placing them in parallel. The impedance of the structure is equal to half the impedance of a structure with a single CDM. Moreover, the curves represented in FIG. 3 give a substantially omnidirectional antenna radiation pattern for an operating frequency of 650 MHz, as represented by the 3D pattern in the left part of the figure and the cross-sectional plane in parallel and cross polarization in the right part of the figure. More specifically, the figure on the left represents a 3D radiation pattern of the structure, as total field (Etotal) and the figure on the right, a 2D radiation pattern in the cross-sectional plane Phi=0°, as parallel (Etheta) and cross (Ephi) components.

Figure 4:
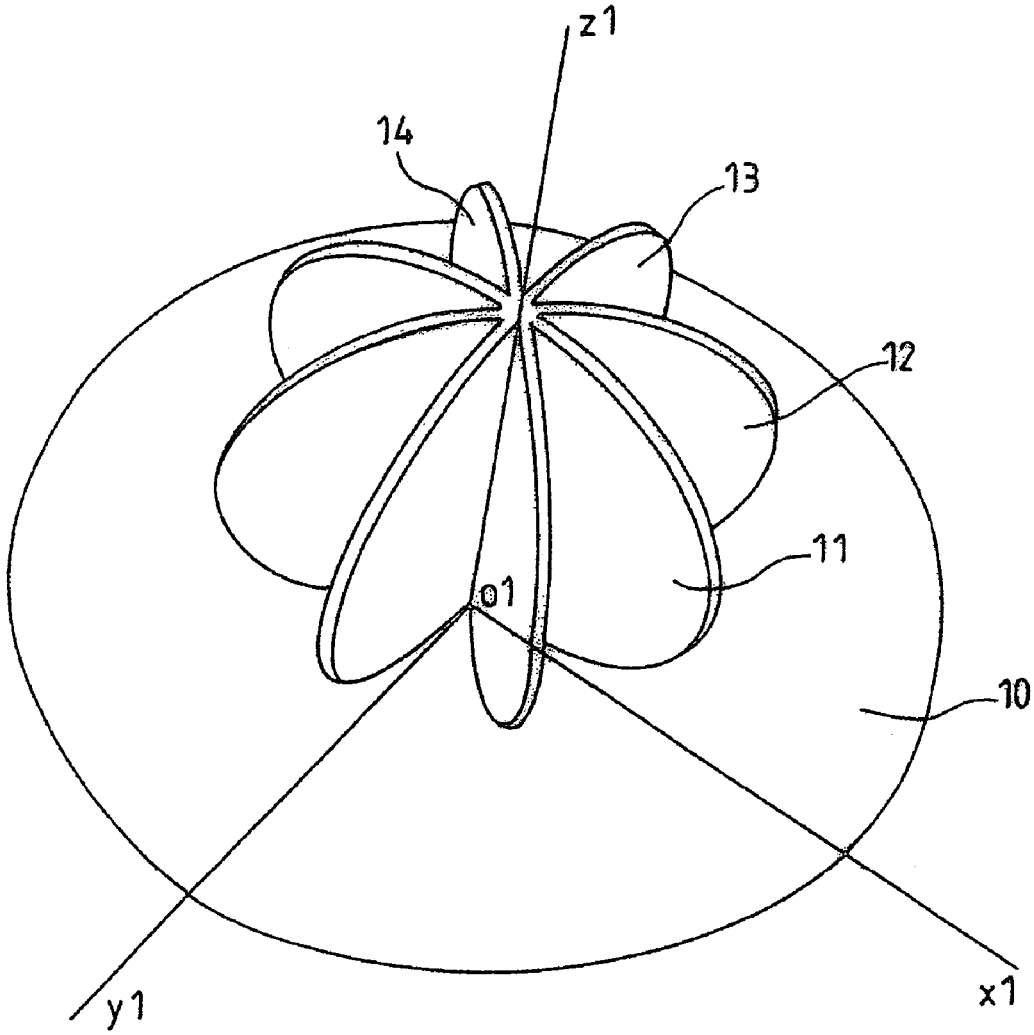
FIG. 4 is a perspective view of an antenna according to another embodiment of the present invention, using 4 CDMs.

Another embodiment of the present invention will now be described with reference to FIGS. 4 to 6. In this case, the antenna in accordance with the invention consists of four CDMs, namely four monopole circular discs 11, 12, 13, 14 that are positioned with respect to one another in such a way as to have a common diameter z1, these monopole discs being mounted perpendicularly to an earth plane 10 lying in the plane x1 o1 y1. In the embodiment represented, the angles between each half-disc 11,12, 12,13 13,14, 14,11 are equivalent and equal to 45°. It is obvious to the person skilled in the art that angles other than 45° may also be contemplated. An antenna of this type has been embodied using the same materials and the same dimensions as the antenna of FIG. 1 and this antenna has been simulated in an identical manner to the antenna of FIG. 1. In this case, the results of the simulation are represented in FIG. 5 as regards the very broad matching band and in FIG. 6 as regards the radiation pattern of the antenna.

Figure 5:
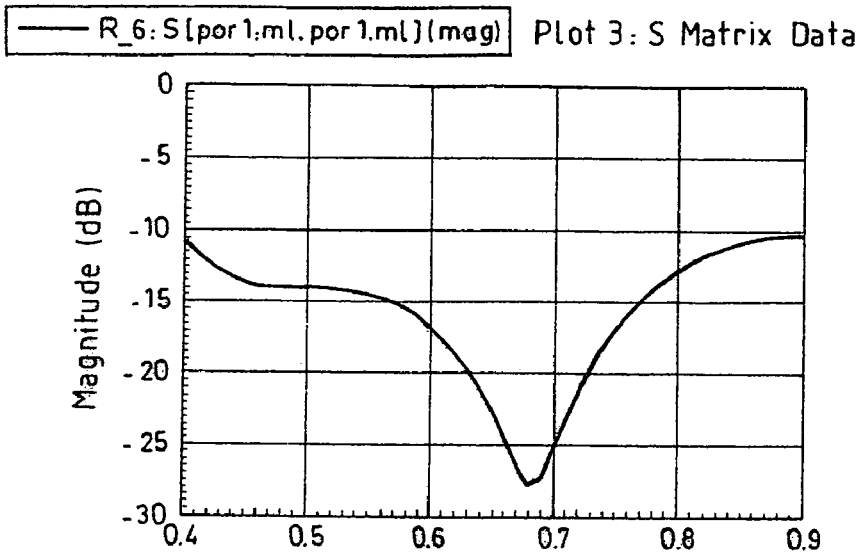
FIG. 5 is a curve giving the matching coefficient as a function of frequency of the antenna represented in FIG. 3.
Figure 6:
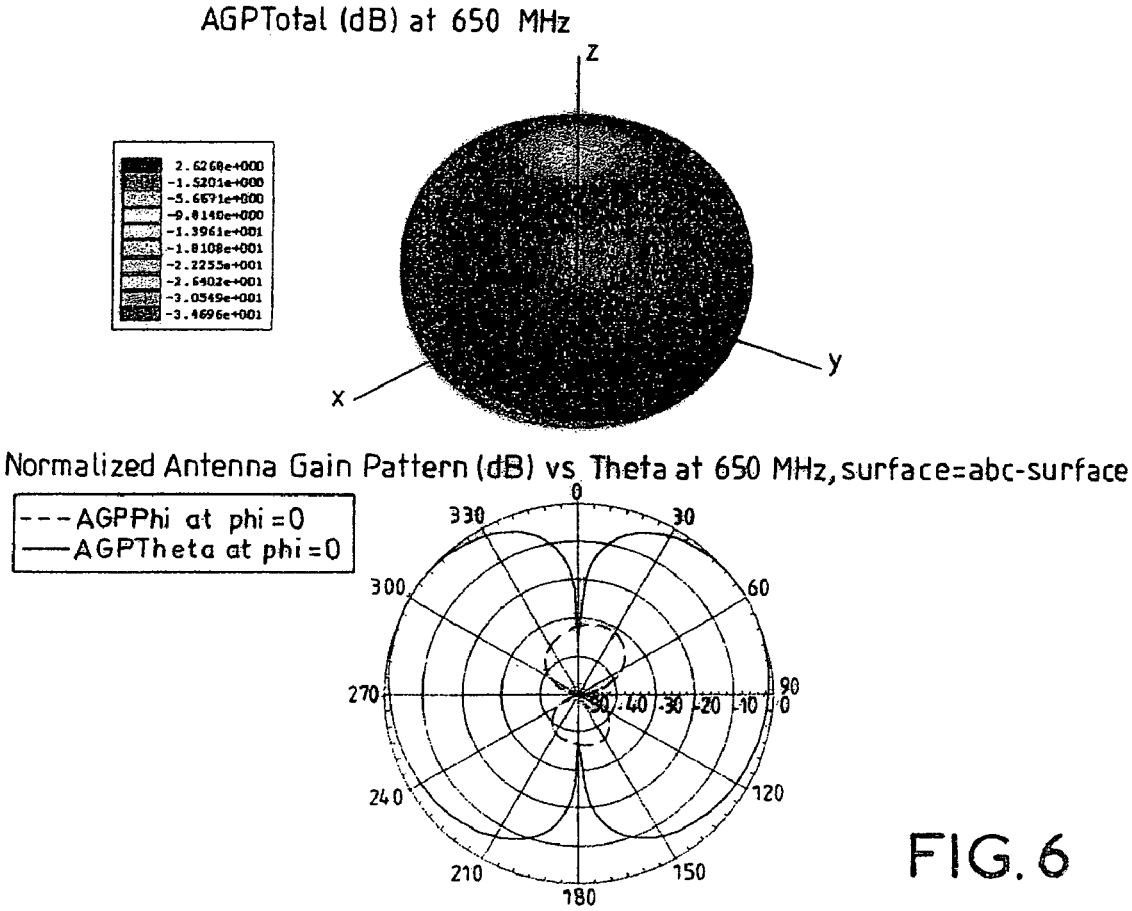
FIG. 6 represents respectively the radiation pattern of the antenna of FIG. 3 in 3D and in a cross-sectional plane in parallel and cross polarization.

According to FIG. 5, good matching is still obtained over a frequency band corresponding to the UHF band of possibly up to −27 dB. Moreover, the radiation pattern represented in FIG. 5 respectively in 3D in the left part of the figure and in a cross-sectional plane in parallel and in cross polarization in the right part shows the obtaining of omnidirectional radiation at the operating frequency of 650 MHz.

Figure 8:
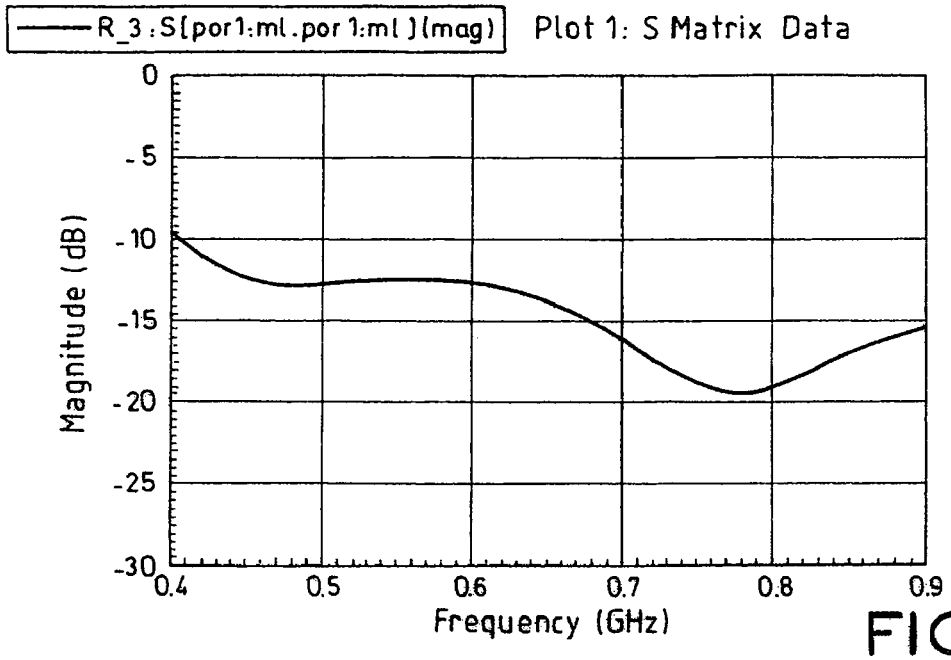
FIG. 8 is a curve giving the matching coefficient as a function of frequency of the antenna of FIG. 7.
Figure 9:
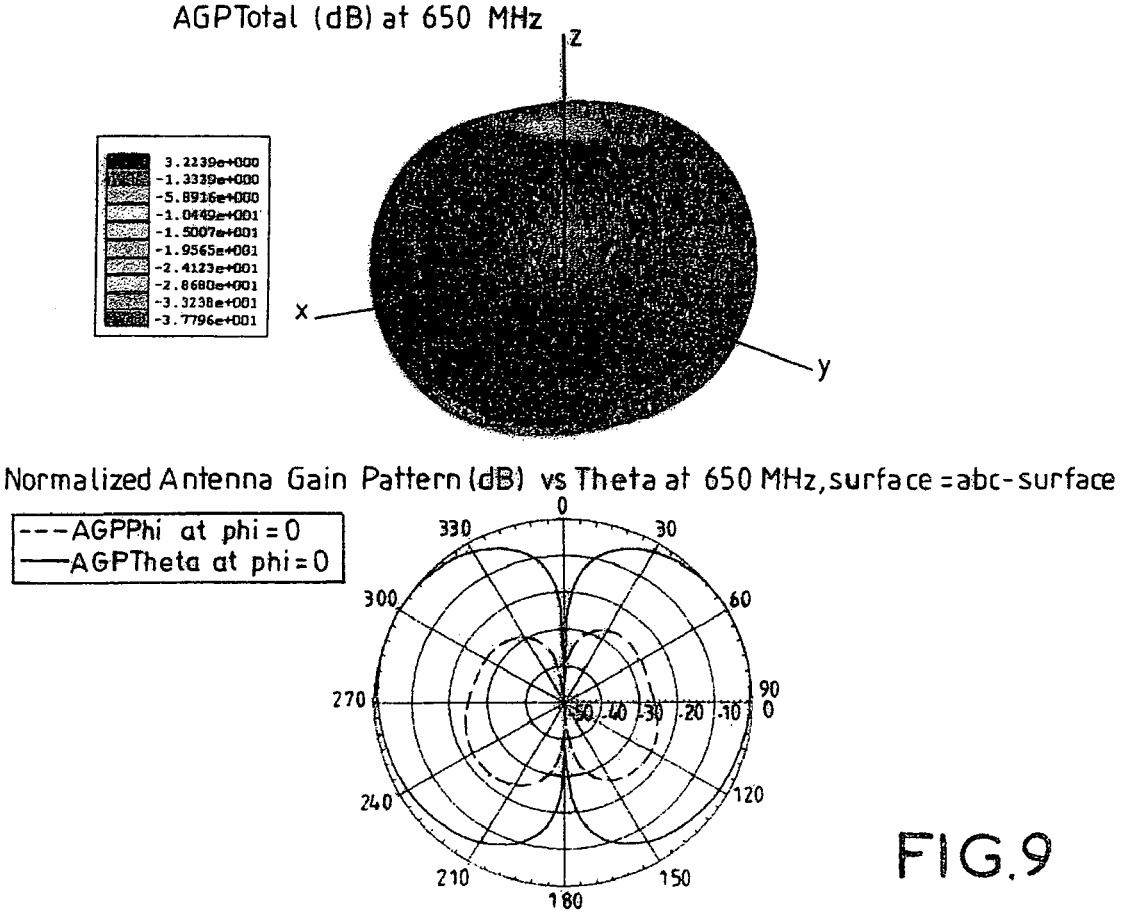
FIG. 9 represents the radiation pattern of the antenna of FIG. 7 respectively in 3D and in a cross-sectional plane in parallel and cross polarization.

Finally a third embodiment will be described with reference to FIGS. 7 to 9.

In this case, the antenna in accordance with the present invention consists of two CDMs (Circular Disc Monopoles), the two discs 21, 22 are positioned with respect to one another in such a way as to have a common diameter according to z2 and are mounted perpendicularly to an earth plane 20 lying in the plane x2 o2 y2.

In this case, the angles that the two monopole discs make between themselves are not equivalent but for example chosen so that one of the two branches of the discs 22 and 21 makes an angle of 45° while the other branch makes an angle of 135°.

Figure 3:
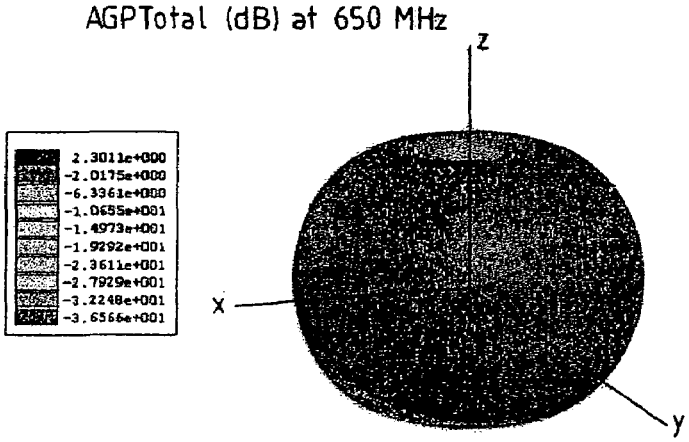
FIG. 3 represents respectively a radiation pattern of the antenna of FIG. 1 in 3D and in a cross-sectional plane with parallel and cross polarization.
Figure 3:
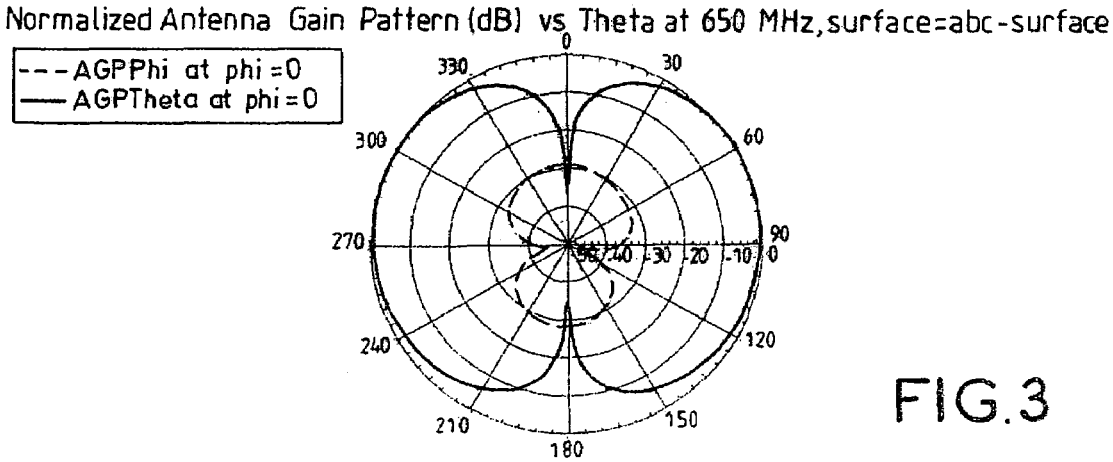
Figure 7:
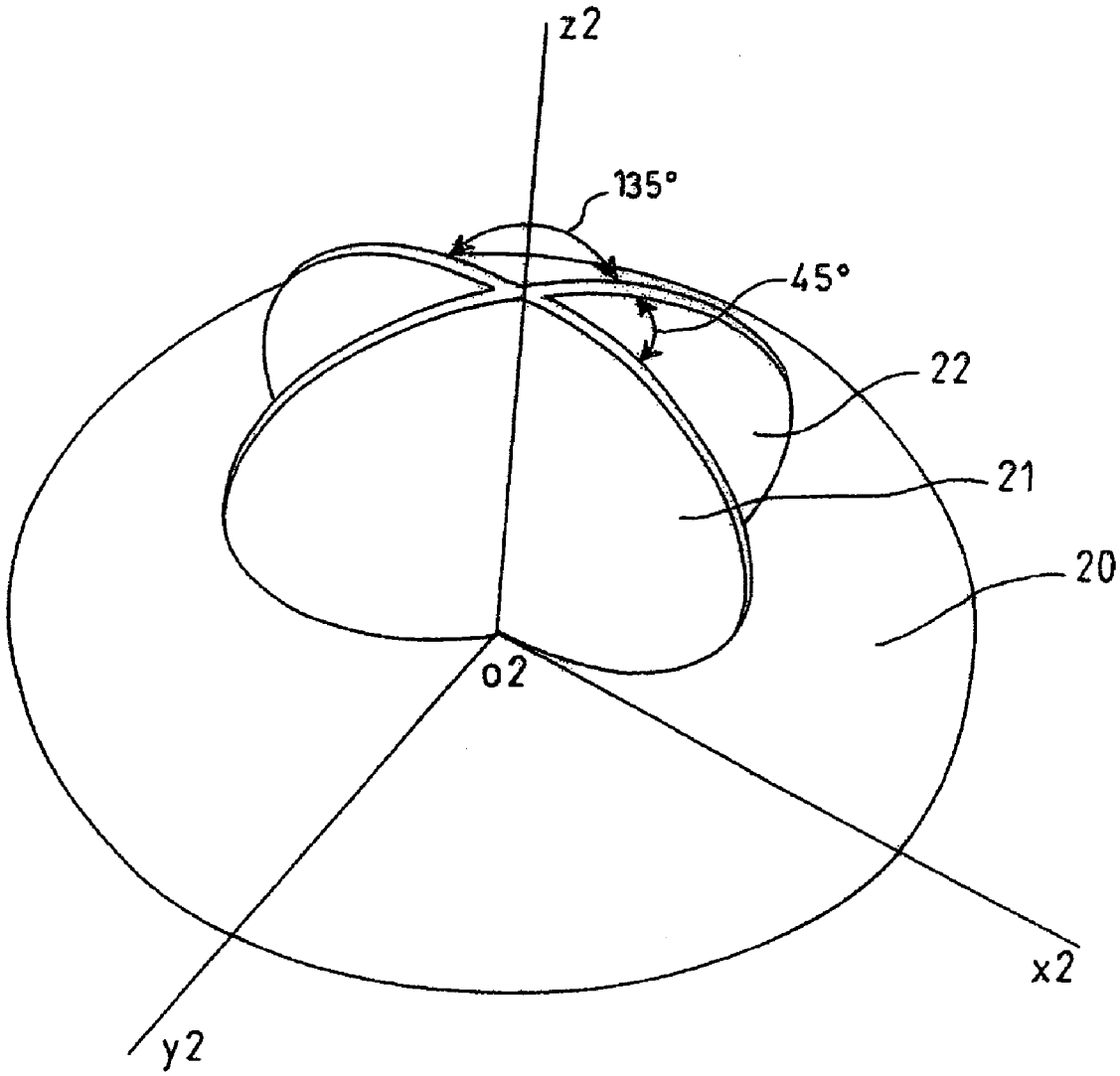
FIG. 7 represents in perspective yet another embodiment of an antenna in accordance with the present invention with two CDMs exhibiting different angles.

The antenna represented in FIG. 7 has been simulated in an identical manner to the antennas of FIGS. 1 and 3. The results of the simulations are represented in FIG. 8 which give the matching of the antenna of FIG. 7 with regard to a standardizing impedance of 25 ohms showing that in this case one still obtains matching of possibly up to −19 dB, in the UHF frequency band lying between 470 MHz and 862 MHz as well as an omnidirectional radiation pattern, as represented in the left part in 3D of FIG. 9 and by the cross-sectional plane in parallel and cross polarization in the right part of the figure. As represented by the simulation results, the various antennas described hereinabove exhibit the following advantages:

A broad bandwidth,

An improved level of matching as compared with that of an antenna consisting of a simple CDM, An omnidirectional pattern in an azimuthal plane and, A low level of cross polarization.

The structure described hereinabove also exhibits the advantage of being simple to embody and the directivity of its radiation may be improved by adding a reflector plane as represented by the reference 5 in FIG. 1. The reflector has no particular position since the radiation of the reflectorless structure is omnidirectional.

What is claimed is:

1. A broadband antenna with omnidirectional radiation comprising, perpendicular to an earth plane, a first circular or semicircular monopole, and at least a second circular or semicircular monopole, the first and second monopoles being nested with respect to one another in such a way as to have a common diameter, wherein said monopoles are nested in such a way that the angles between two monopoles are different from 90°.

2. The antenna according to claim 1, further comprising a reflector plane.

3. The A broadband antenna, with omnidirectional radiation comprising, perpendicular to an earth plane, N semi-circular monopoles, wherein the N semi-circular monopoles are nested with respect to one another in such a way as to exhibit a common diameter and that the angles between the monopoles are unequal.

4. The antenna according to claim 3, further comprising a reflector plane.

* * * * *